US010167711B2

(12) United States Patent
Arabsky et al.

(10) Patent No.: US 10,167,711 B2
(45) Date of Patent: Jan. 1, 2019

(54) PRESSURE ACTIVATED COMPLETION TOOLS AND METHODS OF USE

(71) Applicant: Interra Energy Services Ltd., Calgary (CA)

(72) Inventors: Serhiy Arabsky, Beaumont (CA); Vitaliy Arabsky, Beaumont (CA)

(73) Assignee: INTERRA ENERGY SERVICES LTD., Calgary, Alberta (CA)

( * ) Notice: Subject to any disclaimer, the term of this patent is extended or adjusted under 35 U.S.C. 154(b) by 185 days.

(21) Appl. No.: 15/115,776

(22) PCT Filed: Jan. 29, 2015

(86) PCT No.: PCT/CA2015/000048

§ 371 (c)(1),
(2) Date: Aug. 1, 2016

(87) PCT Pub. No.: WO2015/117221

PCT Pub. Date: Aug. 13, 2015

(65) Prior Publication Data

US 2017/0175508 A1 Jun. 22, 2017

Related U.S. Application Data

(60) Provisional application No. 61/935,723, filed on Feb. 4, 2014.

(51) Int. Cl.
*E21B 34/10* (2006.01)
*E21B 34/14* (2006.01)
(Continued)

(52) U.S. Cl.
CPC ..... *E21B 43/26* (2013.01); *E21B 34/063* (2013.01); *E21B 34/102* (2013.01); *E21B 34/103* (2013.01); *E21B 2034/007* (2013.01)

(58) Field of Classification Search
CPC ..... E21B 2034/007; E21B 34/063; E21B 34/102; E21B 34/125; E21B 34/14
See application file for complete search history.

(56) References Cited

U.S. PATENT DOCUMENTS 5,865,254 A * 2/1999 Huber ..... E21B 34/063 166/126
6,293,342 B1 * 9/2001 McGarian ..... E21B 21/10 166/317

(Continued)

FOREIGN PATENT DOCUMENTS

CA 2776069 A1 11/2012
CA 2755848 A1 4/2013

(Continued)

OTHER PUBLICATIONS

International Search Report with Written Opinion dated May 1, 2015, issued in corresponding International Application No. PCT/CA2015/000048, filed Jan. 29, 2015, 10 pages.

*Primary Examiner* — Kenneth L Thompson

(57) ABSTRACT

Methods and apparatus of pressure activated completion tools for hydraulic fracturing and related processes are provided. In some embodiments, the hydraulic fracturing apparatuses for accessing a subterranean formations can include a tubular body to be fluidly connected in-line with a completion string, the tubular body having at least one burst port configured to receive burst inserts (burst plugs), and a movable inner sleeve that can slide along the inside of the tubular body when exposed to hydraulic pressure from a first position to a second position. The tubular body can also have flow-port(s) that are blocked when the movable inner sleeve is in the first position and opened when the movable inner sleeve slides to the second position.

14 Claims, 7 Drawing Sheets

(51) Int. Cl.

| | |
|---|---|
| ***E21B 43/26*** | (2006.01) |
| ***E21B 34/06*** | (2006.01) |
| *E21B 34/00* | (2006.01) |

(56) References Cited

U.S. PATENT DOCUMENTS

| | | | | |
|---|---|---|---|---|
| 6,450,263 | B1 * | 9/2002 | Schwendemann | E21B 34/063 166/317 |
| 7,096,954 | B2 * | 8/2006 | Weng | E21B 43/26 166/177.5 |
| 8,555,960 | B2 | 10/2013 | Mailand et al. | |
| 8,833,468 | B2 * | 9/2014 | Swan | E21B 21/103 166/373 |
| 8,931,565 | B2 * | 1/2015 | Desranleau | E21B 34/14 166/320 |
| 9,334,710 | B2 * | 5/2016 | Pacey | E21B 34/063 |
| 9,359,864 | B2 * | 6/2016 | Harris | E21B 34/101 |
| 9,476,282 | B2 * | 10/2016 | Anton | E21B 34/063 |
| 2011/0308817 | A1 * | 12/2011 | Ravensbergen | E21B 34/102 166/382 |

FOREIGN PATENT DOCUMENTS

| | | | |
|---|---|---|---|
| WO | 2012/083047 | A2 | 6/2012 |
| WO | 2013/033659 | A1 | 3/2013 |

* cited by examiner

PRESSURE ACTIVATED COMPLETION TOOLS AND METHODS OF USE

CROSS REFERENCE TO RELATED APPLICATIONS

This application claims the benefit of U.S. Provisional Application No. 61/935,723, filed Feb. 4, 2014, which is herein incorporated by reference.

TECHNICAL FIELD

The present disclosure is related to the field of methods and apparatus of completion tools, in particular, methods and apparatus of pressure activated completion tools for hydraulic fracturing.

BACKGROUND

The technique of hydraulic fracturing (commonly referred to as "fracing" or "fracking") is used to increase or restore the rate at which fluids, such as oil, gas or water, can be produced from a reservoir or formation, including unconventional reservoirs such as shale rock or coal beds. Fracing is a process that results in the creation of fractures in rocks. The most important industrial use is in stimulating oil and gas wells where the fracturing is done from a wellbore drilled into reservoir rock formations to increase the rate and ultimate recovery of oil and natural gas.

Hydraulic fractures may be created or extended by internal fluid pressure which opens the fracture and causes it to extend through the rock. Fluid-driven fractures are formed at depth in a borehole and can extend into targeted formations. The fracture height or width is typically maintained after the injection by introducing an additive or a proppant along with the injected fluid into the formation. The fracturing fluid has two major functions, to open and extend the fracture; and to transport the proppant along the length or height of the fracture.

Current fracing systems and methods, however, can be expensive and inefficient.

In many cases, it is desired to target the fracturing process at a specific location in a formation. Prior attempts to address this issue include the devices and methods disclosed in Canadian Patent Application 2,755,848 and Canadian Patent 2,692,377, both of which are hereby incorporated by reference in their entirety.

Both of these documents disclose a burst opening for fracing fluid to exit a completion/service string and access a formation. It is known that burst disks can work in a cemented environment, however, both of these tools are problematic to use in practice. When the fluid pressure is used to burst open these tools, only one out of multiple openings will burst. Pressure is lost at that point and the flow area is severely limited.

Attempts to address the issue of using hydraulic pressure to actuate various downhole components include those disclosed in Canadian Patent 2,637,519, Canadian Patent Application CA 2,719,561, and Canadian Patent Application 2,776,560, all of which are hereby incorporated by reference in their entirety. These methods and apparatuses, however, have their shortcomings. A problem with the exposed vent holes of these devices is that they can be prone to being plugged, restricted, or blocked by debris, especially during cementing operations.

Safer, more reliable, and cost-effective fracing methods and systems are quickly becoming sought after technology by oil and natural gas companies. It is, therefore, desirable to provide an apparatus and method for hydraulic fracturing that can overcome the shortcomings of the prior art and provide a greater degree of reliability.

SUMMARY

Methods and apparatus of pressure activated completion tools for hydraulic fracturing and related processes are provided. In some embodiments, the hydraulic fracturing apparatuses for accessing a subterranean formations can include a tubular body to be fluidly connected in-line with a completion string, the tubular body having at least one burst port configured to receive burst inserts (burst plugs), and a movable inner sleeve that can slide along the inside of the tubular body when exposed to hydraulic pressure from a first position to a second position. The tubular body can also have flow-port(s) that are blocked when the movable inner sleeve is in the first position and opened when the movable inner sleeve slides to the second position.

In some embodiments, the pressure activated tools can be used in a well bore to allow for multistage completions to be performed reliably with the use of cement or packers for zonal isolation. The tools can allow for large flow areas without restriction during stimulation treatment via straddle packer or liner.

Broadly stated, in some embodiments, a hydraulic fracturing apparatus is provided for perforating a subterranean formation, the apparatus comprising: a tubular body configured to be fluidly connected in-line with a completion string having an upstream and a downstream, the tubular body having at least one burst port, the at least one burst port configured to receive a burst plug; a movable inner sleeve within the tubular body that can slide along the inside of the tubular body from a first position to a second position when exposed to hydraulic pressure, and at least one flow-port in the tubular body that is blocked when the movable inner sleeve is in the first position and opened when the movable inner sleeve slides to the second position.

In some embodiments, the apparatus can further comprise a burst plug disposed within the at least one burst port, the burst plug configured to burst at a predetermined pressure threshold. In some embodiments, the at least one flow port is spaced away from the at least one burst port. In some embodiments, the apparatus can further comprise a fluid compartment in fluid communication with the at least one burst port, the fluid compartment configured to receive an incompressible fluid. In some embodiments, the movable inner sleeve abuts the fluid compartment. In some embodiments, the burst plug disposed within the at least one burst port is configured to burst open in response to pressure transferred from the movable inner sleeve through the incompressible fluid to the burst plug. In some embodiments, the movable inner sleeve is configured to move to its second position in response to pressure. In some embodiments, the incompressible fluid is oil. In some embodiments, the apparatus can further comprise a locking means to lock the movable inner sleeve at a predetermined position within the tubular body. In some embodiments, the predetermined position of the movable inner sleeve is the second position. In some embodiments, the locking means comprises a C snap ring and a corresponding groove. In some embodiments, the at least one burst port is configured to receive a shield. In some embodiments, the at least one flow-port is configured to receive a shield. In some embodiments, the at least one flow-port is larger in diameter than the at least one burst port. In some embodiments, the at least one flow-port is approximately twice as large in diameter than the at least one burst port. In some embodiments, the at least one flow-port has a diameter that is choked in order to limit fluid flow out of the flow-port or to create a jetting effect.

Broadly stated, in some embodiments, a method is provided for hydraulic fracturing a formation in a well, the method comprising the steps of: providing an apparatus as described herein; supplying pressurized fracture fluid to the apparatus; sliding the movable inner sleeve into the second position; opening the at least one flow-port; allowing the pressurized fracture fluid to flow through the flow-port to contact the formation; and fracturing the formation in the well.

DETAILED DESCRIPTION OF EMBODIMENTS

An apparatus and method for hydraulic fracturing are provided herein.

Figure 1:
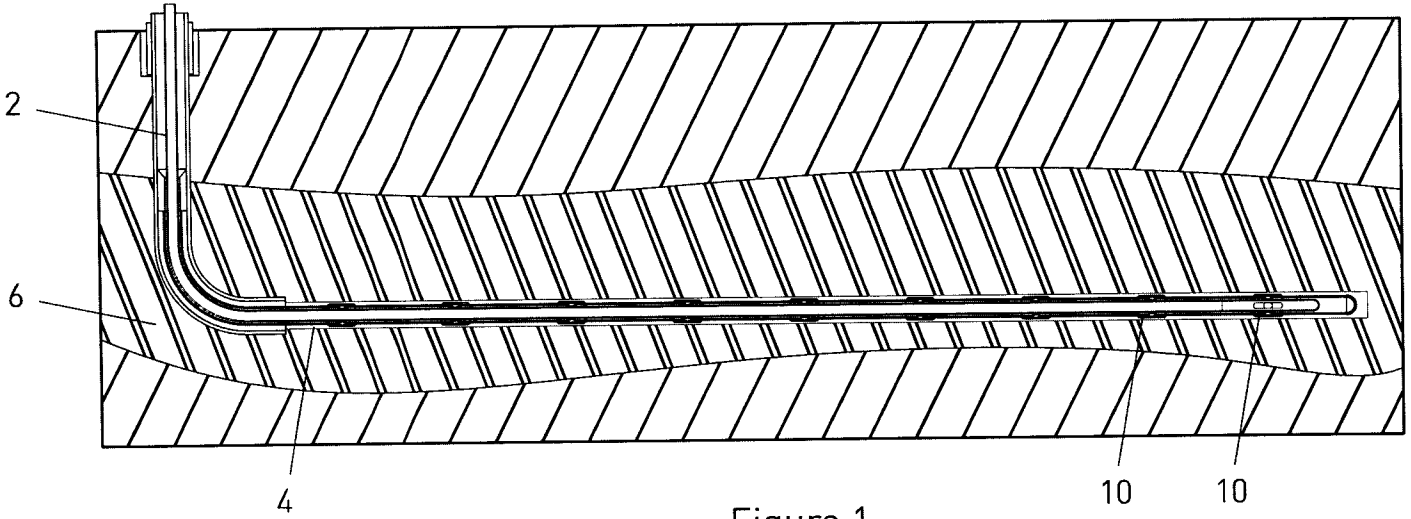
FIG. 1 is a diagram of a side elevation view of a well depicting an embodiment of an apparatus for hydraulic fracing where formation and well head are visible.
Figure 2A:
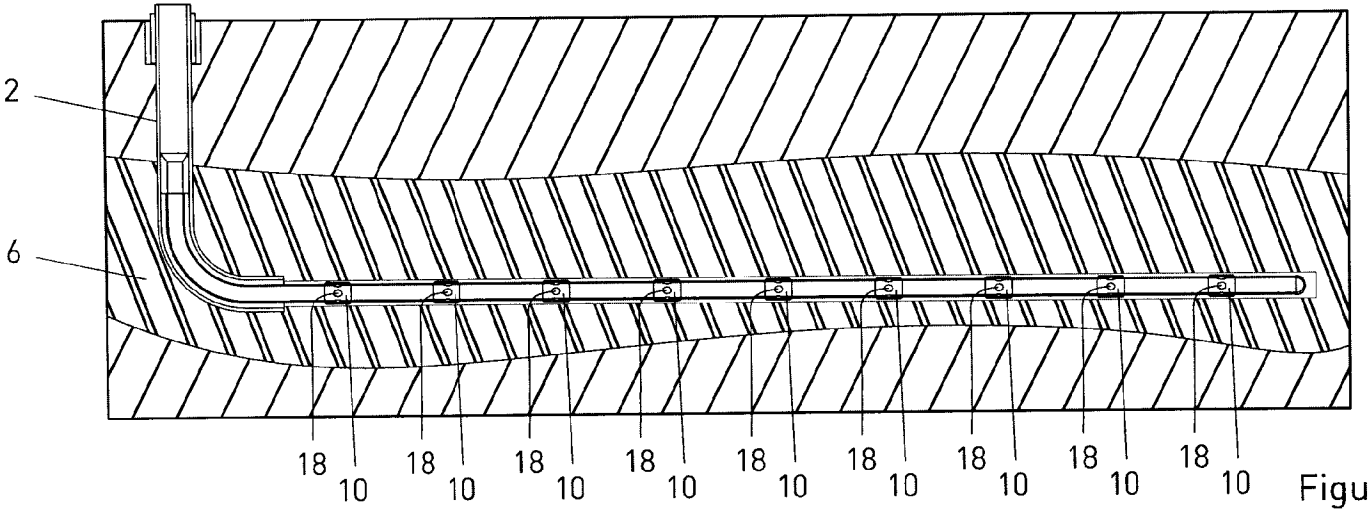
FIGS. 2A and 2B are diagrams of a side elevation view of a well depicting embodiments of an apparatus for hydraulic fracing along a completion string.
Figure 2B:
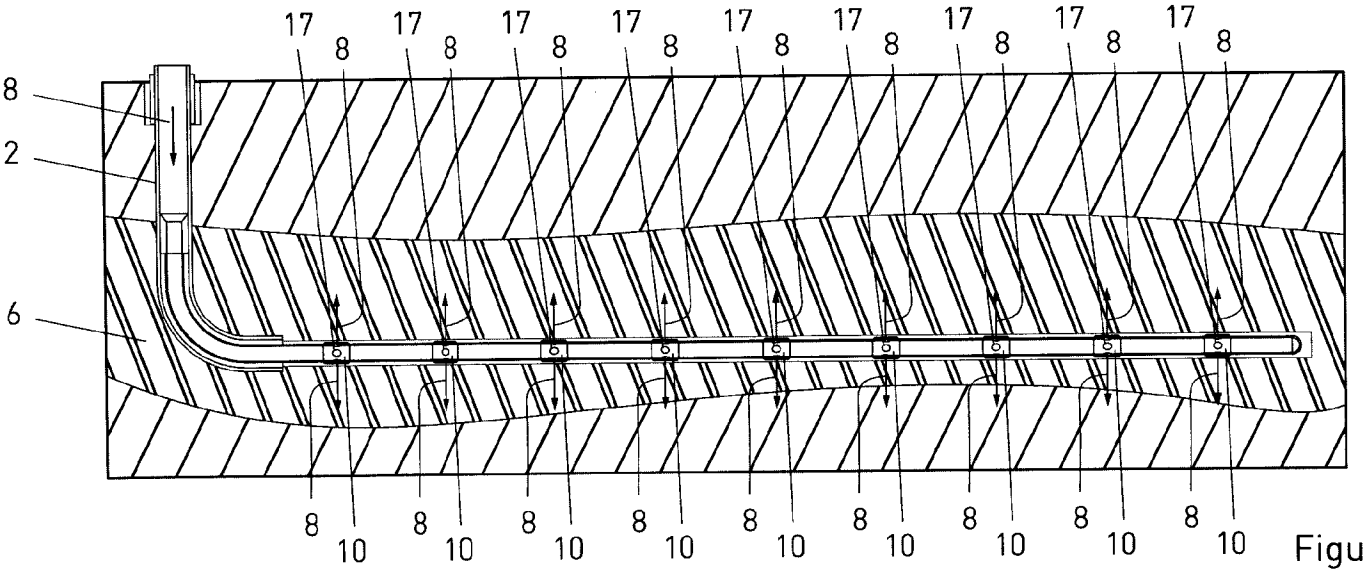

Referring to FIG. 1 and FIG. 2, a well 2 is shown from a side elevation view where service/completion string 4 is downhole and proximate formation 6. Fracing fluid 8 can be pumped downhole through service/completion string 4 to fracing apparatus 10. Apparatus 10 can then release pressurised fracing fluid 8 to fracture formation 6 as shown in FIG. 2B.

Figure 3:
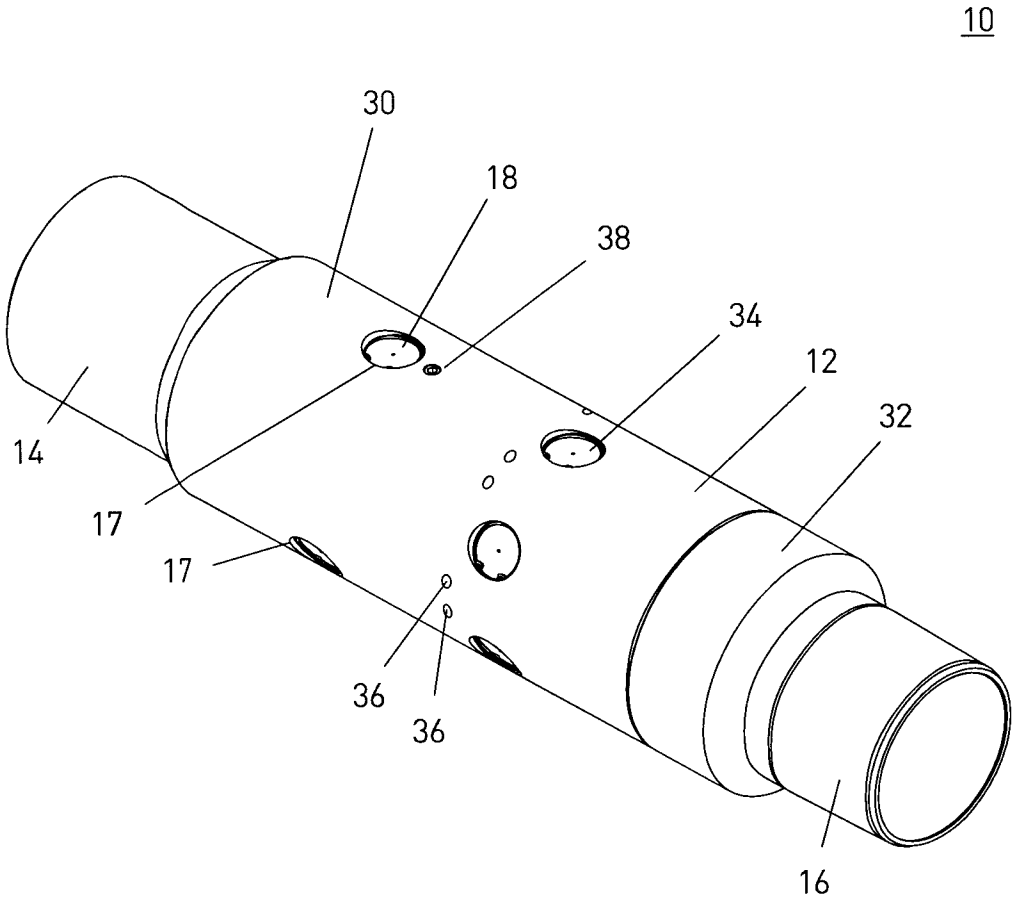
FIG. 3 is a perspective view of an embodiment of an apparatus for hydraulic fracing.

Referring now to FIG. 3, apparatus 10 is shown comprising a main body 12 with a top connector 14 and a bottom connector 16. Top and bottom as used herein are relative term and it would be understood by one skilled in the art that the orientation could be inverted without detracting from the function of apparatus. Similarly, top and bottom can be interchanged with terms such as left and right, or upstream and downstream, as required by the context of apparatus 10. The main body 12 can be tubular as to allow a fluid connection with a service/completion sting 4 and allow fracing (or other fluid) to pass through body 12.

Figure 5A:
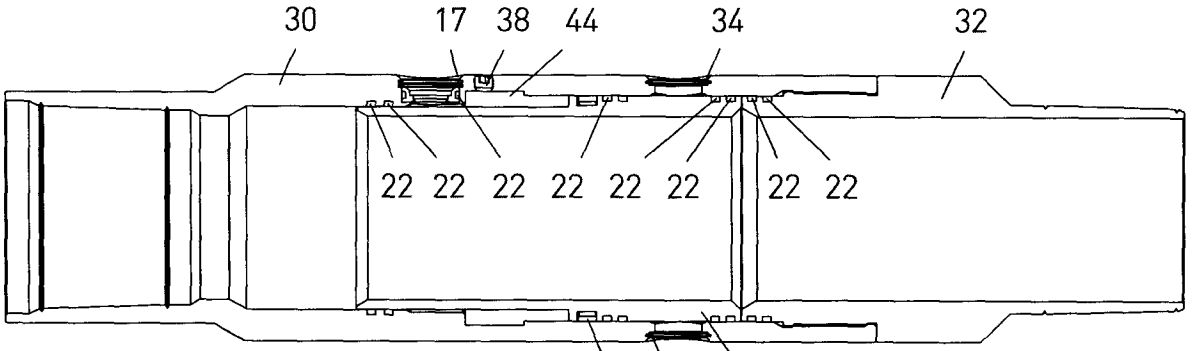
FIGS. 5A to 5D are cross-sectional and close-up views of the embodiment of FIG. 3.
Figure 5B:
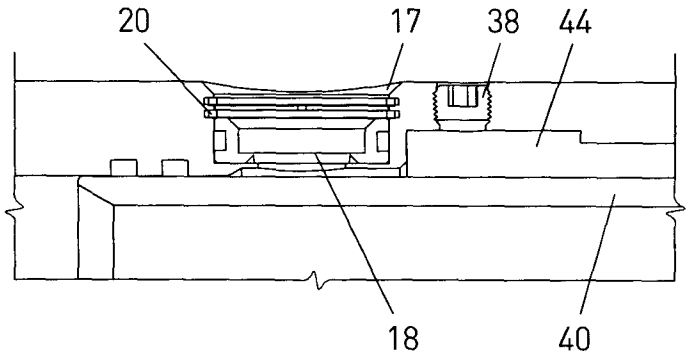
Figure 5C:
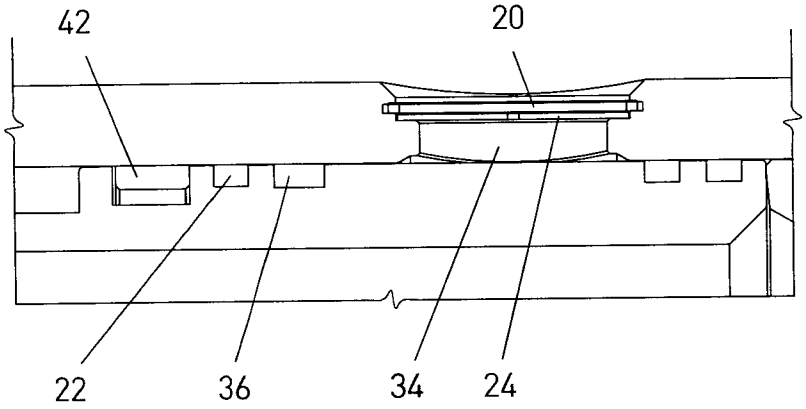
Figure 5D:
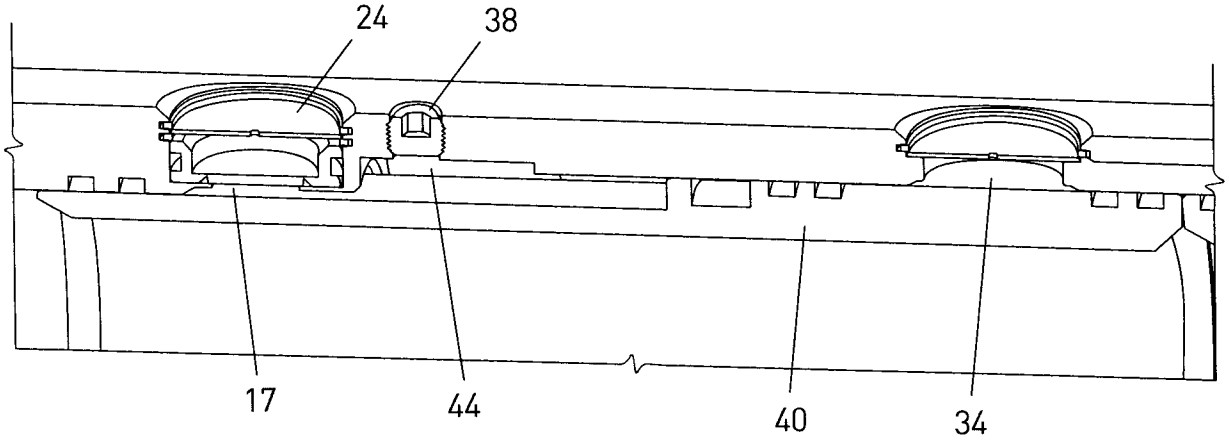

Main body 12 can include one or more burst ports 17 which can be configured to receive a burst plug 18 and burst plug 18 can be disposed within burst ports 17 to initially block fluid flow through burst ports 17. It would be understood that burst plug 18 could also be called a burst disk or a burst insert. In some embodiments, burst plug 18 can be positioned towards the interior of, and blocking the opening of burst port 17. Retention means, such as a burst plug retainer 20 (such as a snap ring as shown in FIG. 5B) and/or a seal 22 can be used to hold burst plug 18 in place.

An additional shield 24 can also be used to cover burst port 17. In some embodiments, shield 24 can be a thin aluminum shield, although it would be understood that other suitable materials could be used. In some embodiments, shield 24 can be positioned towards the exterior of the opening of burst port 17. In some embodiments, a void can be defined therewithin, for example the void can be defined between the shield 24 and burst plug 18. Like burst plug 18, shield 24 can provide additional blocking function to prevent debris and other substances from blocking burst port 17. In some cases, shield 24 can block cement and other debris from entering burst port 17. In some embodiments, shield 24 can be vented to provide a means of equalizing pressure between the void and an annulus formed between the tubular member and the wellbore. In some embodiments, the void can be filed with a substance (such as a gel or grease) for resisting entry of a wellbore fluid (such as cement) thereinto through the hole. Shield 24 can prevent the gel or grease in that void from escaping.

In some embodiments, burst plug 18 can be burst plugs as described in U.S. 61/921,254, incorporated by reference herein in its entirety. In these embodiments, burst plug 18 does not require an atmospheric chamber or a core that disengages. It would also be appreciated that other burst plug types and designs as known in the art could be used without detracting from function of apparatus 10.

Referring back to FIG. 3, in some embodiments, apparatus 10 can comprise and upper housing 30 and a lower housing 32. Apparatus 10 can also comprise flow-ports 34 downstream of burst ports 17. In some embodiments, flow-ports 34 can be larger in diameter than burst ports 17, in some cases being approximately twice as large. In some embodiments, the diameter of flow-ports 34 can be choked in order to limit fluid flow out of the flow-port or to create a jetting effect.

In some embodiments, the void in flow-ports 34 can be filled with grease and shield 24 can be placed there (loosely fitting) to prevent the grease from leaking out. At least one fluid fill plug 38 can also be included in apparatus 10. In some embodiments, apparatus 10 can also include shear pins 36 and a groove on shift sleeve 40 to receive shear pin 36.

Figure 4:
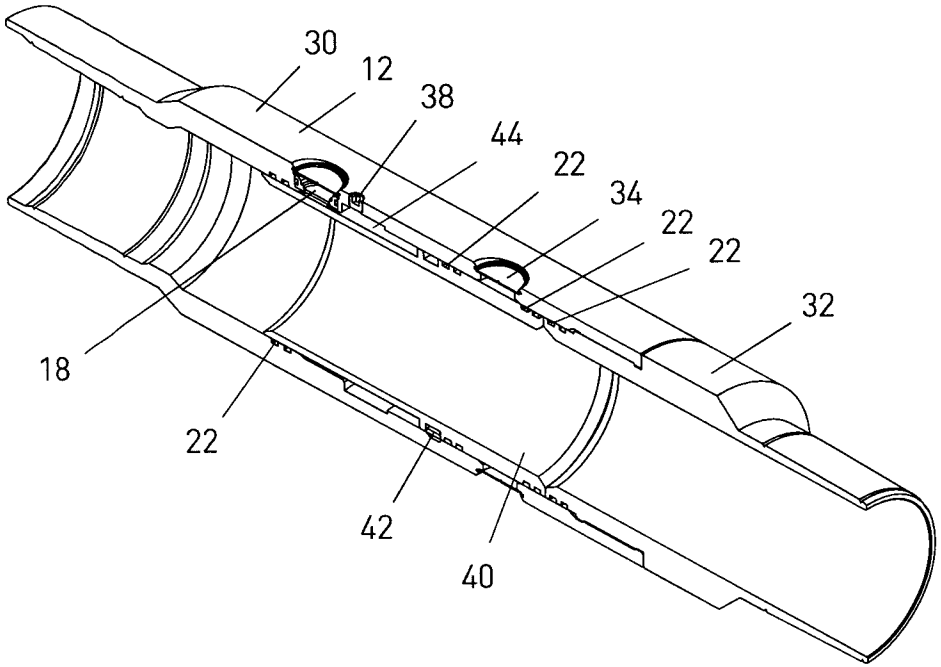
FIG. 4 is a perspective, cross-sectional view of the embodiment of FIG. 3.

FIG. 4 depicts a movable inner shift sleeve 40 disposed within upper housing 30. Seals 22 can be used around sleeve 40. Sleeve 40 can be slidable between at least two positions, a first position where flow ports 34 are blocked and a second position where flow ports 34 are opened/exposed to allow fluid communication (for the flow of pressurised frac fluid 8, as an example) between the inside of the tubular apparatus 10 and the external of apparatus 10. In some embodiments, a "C" snap ring 42 can also be used as a means for locking sleeve 40 in a predetermined position.

A fluid compartment 44 can also be positioned between sleeve 40 and upper housing 30. Prior to operation, fluid compartment 44 can be filled with a fluid through fluid fill plug 38. In some embodiments, fluid compartment 44 can be filled with an incompressible fluid, such as oil although it would be understood that other fluids could accomplish the same function. The incompressible fluid in compartment 44 can be configured to act as a media to transfer uphole pressure, applied by pressurised fracing fluid 8 to inner sleeve 40, to the burst plug 18. Burst plug 18 can be configured to be a releasing mechanism that can burst open at a threshold pressure level, for example approximately 3000-3500 psi. The incompressible fluid is then allowed to exit through opened burst port 17 leaving an empty compartment 44, and in turn, allow the inner sleeve to shift into the second position to expose flow-ports 34.

In operation, and referring to FIGS. 5A to 5D, apparatus 10 can use sleeve 40 to cover otherwise unblocked flow-ports 34 and to shift sleeve 40 and expose multiple flow-ports 34 simultaneously. When fluid pressure is increased inside of apparatus 10, sleeve 40 tries to shift upstream due to a pressure differential that can be created by the seals positioned at different diameters. In some embodiments, shift sleeve 40 can have a larger diameter, for example an approximately 4.875" diameter, at the point where shift sleeve 40 is proximate flow ports 34, and shift sleeve 40 can have a smaller diameter, for example an approximately 4.375" diameter where the shift sleeve 40 is proximate seals 22 and burst ports 17. As would be understood, Pressure=Force/Area or F=Pressure*Area; thus a larger area can result is a greater force that can push the sleeve 40 uphole/upstream.

Figure 5E:
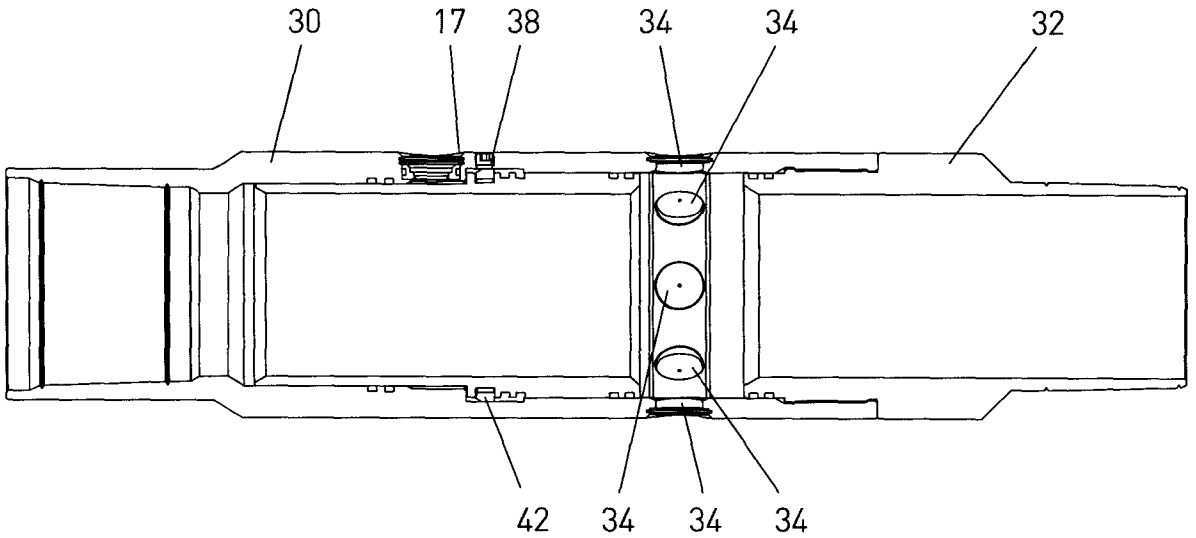
FIG. 5E is a cross-sectional view of the embodiment of FIG. 3 in an open position.

In turn, such an uphole/upstream shift can thereby put pressure on fluid compartment 44; which in turn can put pressure on burst plug 18. Once a predetermined threshold pressure, for example approximately 3000-3500 psi is reached, burst plug 18 can burst allowing the escape of the incompressible fluid (for example, oil). Upstream movement of the shift sleeve 40 can then be allowed, exposing flow-ports 34 and allowing pressurized fracing fluid 8 to exit apparatus 10 to fracture formation 6. See FIG. 5E for example.

In embodiments using shear pins 36, once a predetermined threshold pressure, for example approximately 3000-3500 psi is reached, shear pins 36 can shear and burst plug 18 can burst allowing the escape of the incompressible fluid (for example, oil). In some embodiments, the predetermined threshold pressure, for example approximately 3000-3500 psi, can be set by a combination of both of the threshold pressures of shear pins 36 and burst plug 18.

The volume of incompressible fluid can be very small, allowing for burst plug 18 to be a debris barrier to prevent anything from getting into fluid compartment 44 and preventing the shifting of sleeve 40.

Prior art sleeve systems have not been greatly successful because a "differential" chamber with a vent hole was required in order to make the sleeve shift due to pressure. A problem with vent holes is that they are prone to being obstructed by debris, especially during cementing operations. As such, the apparatus and methods of the present disclosure still burst the tool open, but instead of actually releasing frac fluid and fracing through the burst ports 17, burst ports 17 can be used as an activation feature to open/expose the flow ports 34.

As such, burst plug 18 can be used in burst ports 17 for at least two reasons. The first, in a closed, un-burst configuration, is to act as a barrier and to prevent the debris from entering the compartment 44 and preventing proper function of apparatus 10. Secondly, burst plug 18 can be configured during manufacture or otherwise to be burst in response to a predetermined pressure. This predetermined pressure can therefore be the threshold activation value of apparatus 10 as when burst plug 18 bursts into an open configuration, the oil is allowed to escape compartment 44 and sleeve 40 is able to shift upstream to expose flow ports 34. Pressurized fracture fluid is then able to flow through the opened flow-port to contact the formation in order to fracture the formation in the well.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A hydraulic fracturing apparatus for perforating a subterranean formation, the apparatus comprising:

(i) a tubular body configured to be in fluid communication with a downhole completion string having an upstream and a downstream, the tubular body having at least one burst port configured to receive a burst plug wherein the burst plug is configured to burst at a threshold pressure;

(ii) a movable inner sleeve within the tubular body that can slide inside of the tubular body from a first position to a second position when exposed to hydraulic pressure;

(iii) a fluid compartment positioned between the movable inner sleeve and the tubular body, the fluid compartment configured to receive a compartment fluid and operable for fluid communication of the compartment fluid from inside the fluid compartment to outside the burst port, the communication of the compartment fluid to outside the burst port being prevented by the burst plug when disposed in the burst port and the compartment fluid being able to pass to outside the burst port when the burst plug is not disposed in the burst port; and (iv) at least one flow-port operable for fluid communication of pressurized fluid from inside the tubular body to outside the tubular body, the communication of the pressurized fluid from inside the tubular body to outside the tubular body being prevented by the movable inner sleeve when the movable inner sleeve is in the first position and the pressurized fluid being able to pass through the at least one flow-port to outside the tubular body when the movable inner sleeve is in the second position, wherein in operation:

the burst plug that is disposed within the at least one burst port bursts in response to hydraulic pressure equal to or greater than the threshold pressure that is transferred from the pressurized fluid down the downhole completion string to the movable inner sleeve through the compartment fluid that is received by the fluid compartment to the burst plug; and upon the bursting of the burst plug, the compartment fluid passes to outside the burst port and the movable inner sleeve slides from the first position to the second position such that the pressurized fluid can pass through the opened at least one flow-port.

2. The apparatus of claim 1, further comprising a burst plug disposed within the at least one burst port.

3. The apparatus of claim 1, wherein the fluid compartment is further configured to receive a fluid fill plug.

4. The apparatus of claim 1, wherein the fluid compartment is configured to receive an incompressible fluid.

5. The apparatus of claim 4, wherein the incompressible fluid is oil.

6. The apparatus of claim 1, further comprising a locking means to lock the movable inner sleeve at a predetermined position within the tubular body.

7. The apparatus of claim 6, wherein the predetermined position of the movable inner sleeve is the second position.

8. The apparatus of claim 6, wherein the locking means comprises a C snap ring and a corresponding groove.

9. The apparatus of claim 1, wherein the at least one burst port is configured to receive a shield.

10. The apparatus of claim 1, wherein the at least one flow-port is configured to receive a shield.

11. The apparatus of claim 1, wherein the at least one flow-port is larger in diameter than the at least one burst port.

12. The apparatus of claim 1, wherein the at least one flow-port has a diameter that is choked in order to limit fluid flow out of the flow-port or to create a jetting effect.

13. A method of hydraulic fracturing a formation in a well, the method comprising the steps of:

(i) supplying fracture fluid at a pressure equal to or greater than the threshold pressure to the hydraulic fracturing apparatus of claim 1 fluidly connected in-line with a completion string and proximate to the formation;

(ii) sliding the movable inner sleeve into the second position;

(iii) opening the at least one flow-port;

(iv) allowing the pressurized fracture fluid to flow through the flow-port to contact the formation; and (v) fracturing the formation in the well.

14. The method of claim 13, wherein the threshold pressure ranges from about 3000-3500 psi.

* * * * *